United States Patent [19]

Ostertag

[11] 4,194,582

[45] Mar. 25, 1980

[54] DOUBLE ACTING SHOCK ABSORBERS FOR DRILL STRINGS

[75] Inventor: Alfred Ostertag, Celle, Fed. Rep. of Germany

[73] Assignee: Christensen, Inc., Salt Lake City, Utah

[21] Appl. No.: 919,790

[22] Filed: Jun. 28, 1978

[51] Int. Cl.[2] ..... E21B 17/04

[52] U.S. Cl. ..... 175/321; 175/227; 175/299; 267/71; 267/137

[58] Field of Search ..... 175/299, 321; 267/60, 267/125, 137, 162, 170, 171, 69; 166/178; 64/23, 1 V; 285/302; 92/85 A, 85 R; 173/162

[56] References Cited

U.S. PATENT DOCUMENTS

| | | | |
|---|---|---|---|
| 2,372,214 | 3/1945 | Loepsinger | 267/71 X |
| 2,665,902 | 1/1954 | Allen | 267/69 |
| 3,735,827 | 5/1973 | Berryman | 166/178 X |
| 3,871,193 | 3/1975 | Young | 175/321 X |
| 3,949,150 | 4/1976 | Mason et al. | 175/321 |

*Primary Examiner*—Ernest R. Purser
*Assistant Examiner*—Nick A. Nichols, Jr.
*Attorney, Agent, or Firm*—Subkow and Kriegel

[57] ABSTRACT

A telescopic shock absorber for incorporation in a drill string connected to a rotary bit for drilling a bore hole in earth formations, the shock absorber including a single spring assembly which is compressed downwardly when sufficient downwardly directed drilling weight is transmitted from the drill string through the shock absorber to the drill bit, and which is compressed upwardly when the internal drilling fluid pressure in the shock absorber fully overcomes the downwardly directed drilling weight, assuring that the spring assembly is in its compressed condition when the shock absorber is telescoped or extended, enabling it to absorb shocks and vibrations incident to the drilling operation and under both conditions.

14 Claims, 9 Drawing Figures

DOUBLE ACTING SHOCK ABSORBERS FOR DRILL STRINGS

The present invention relates to telescopic shock absorbers to be embodied in drill strings secured to bits for rotary drilling bore holes in earth formations, and particularly to shock absorbers capable of effective operation when downwardly imposed drilling weight overcomes the drilling fluid pressure in the shock absorber, as well as when the drilling fluid pressure overcomes the downwardly imposed drilling weight and effects extension of the shock absorber.

The U.S. patent application of James T. Aumann, Ser. No. 879,237, filed Feb. 21, 1978, for "Dual Spring Drill String Shock Absorber," assigned to the assignee of a present application, discloses a drill string shock absorber embodying two separate spring assemblies, one of which is compressed as a result of drilling weight transmitted through the shock absorber to the drill bit, which overcomes the elevating force of the drilling fluid flowing through the shock absorber. The other spring assembly is compressed when the drilling weight transmitted through the shock absorber is insufficient to overcome the elevating force of the fluid pressure, flowing through the shock absorber. This shock absorber possesses the advantage of functioning properly when low drilling weight is imposed upon it, as well as when high weight is imposed upon it. However, only one of the two spring assemblies is effective at a time, the other being unloaded. This reduces the fatigue life of the spring assemblies, requiring replacement of springs and other parts, and adding to the cost of the drilling operation and drilling equipment.

With respect to the present invention, the telescopic shock absorber has inner and outer tubular members slidably spline to each other to transmit torque to the drilling bit. It included a single spring assembly, which is compressed in one direction when high drilling loads or weight are transmitted through the shock absorber, and compressed in the opposite direction when the drilling fluid pressure is sufficiently high to exert an elevating force extending the upper one of the tubular members with respect to the lower tubular member. Accordingly, the single spring assembly is under compression under all drilling conditions, maintaining a compressive force on the shock absorber capable of damping vibrations and shock loads imposed on the drill string during the drilling operation.

The provisions of the shock absorber embodying a single spring assembly enables the shock absorber to be of simpler construction and of shorter length, substantially lowering the cost of manufacture and maintenance of the shock absorber and contributing to its longer life. In addition, the maintenance of the spring assembly under load during the various conditions encountered in the bore hole during the drilling operation results in the spring assembly having a much higher fatigue life than spring assemblies which are loaded under some conditions in drilling the bore hole and unloaded under other conditions.

This invention possesses many other advantages, and has other purposes which may be made more clearly apparent from a consideration of a form in which it may be embodied. This form is shown in the drawings accompanying and forming part of the present specification. It will now be described in detail, for the purpose of illustrating the general principles of the invention;

but it is to be understood that such detailed description is not to be taken in a limiting sense.

Referring to the drawings:

FIGS. 1*a*, 1*b*, 1*c*, 1*d* and 1*e* together constitute a quarter longitudinal section through a shock absorber apparatus embodying the invention, FIGS. 1*b*, 1*c*, 1*d* and 1*e* being lower continuations, respectively, of FIGS. 1*a*, 1*b*, 1*c* and 1*d*;

Figure 1A:
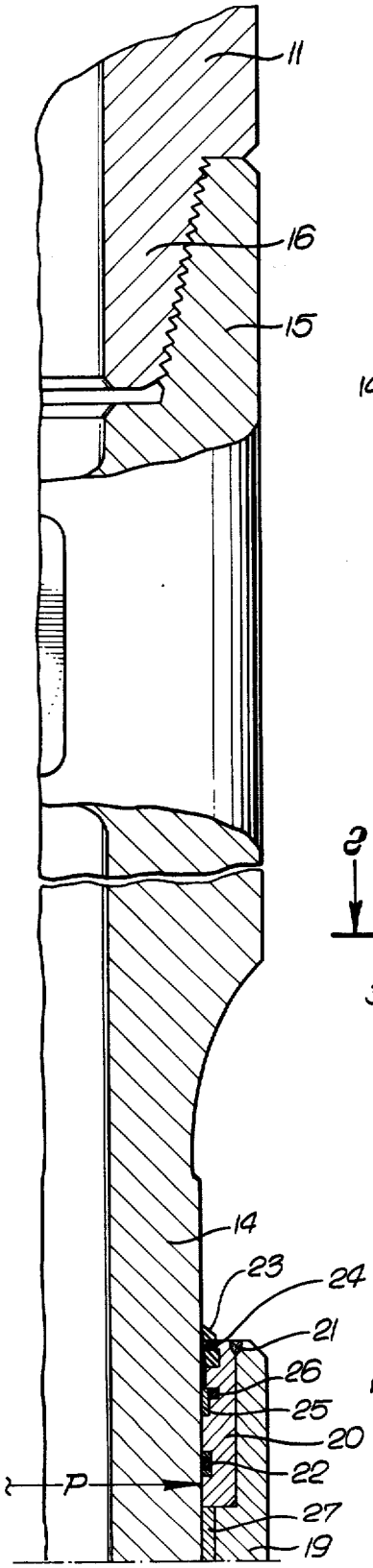
Figure 1B:
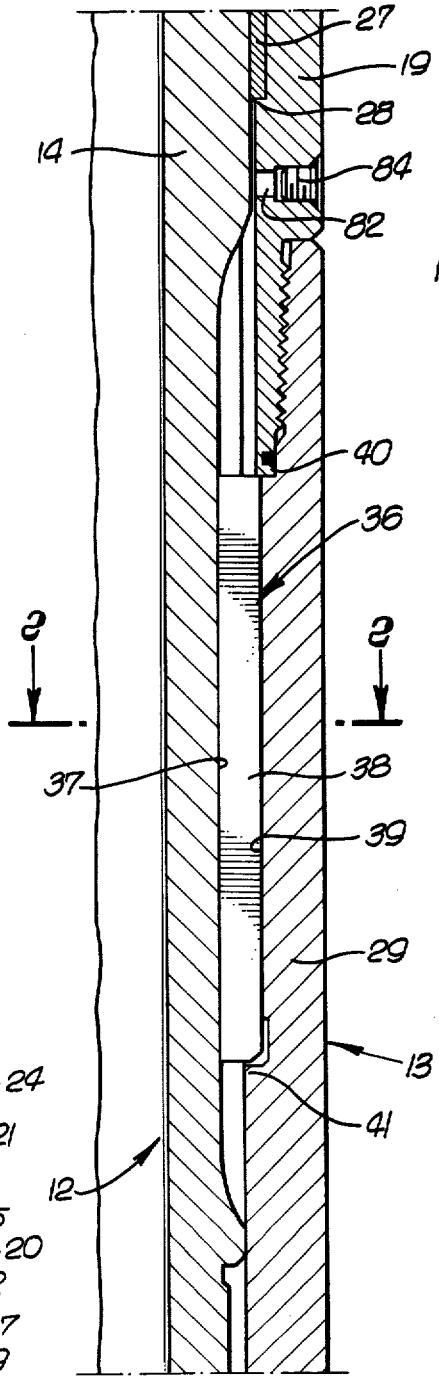
Figure 1C:
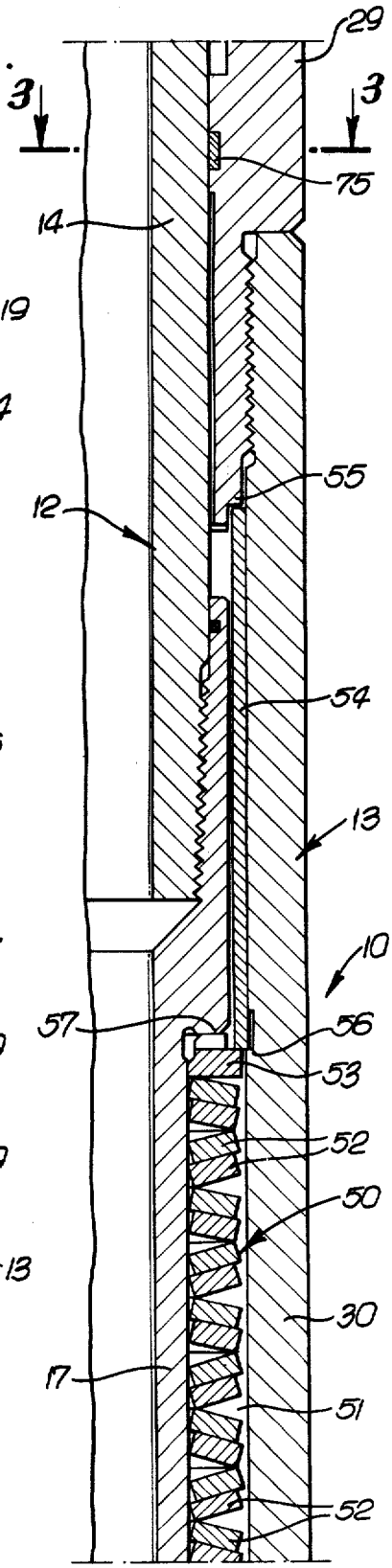
Figure 1D:
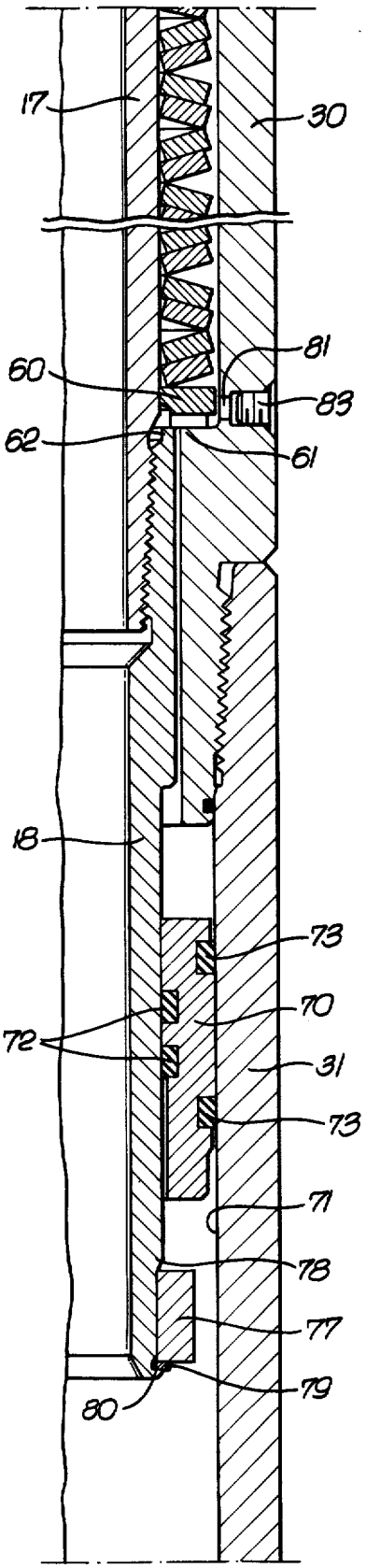
Figure 1E:
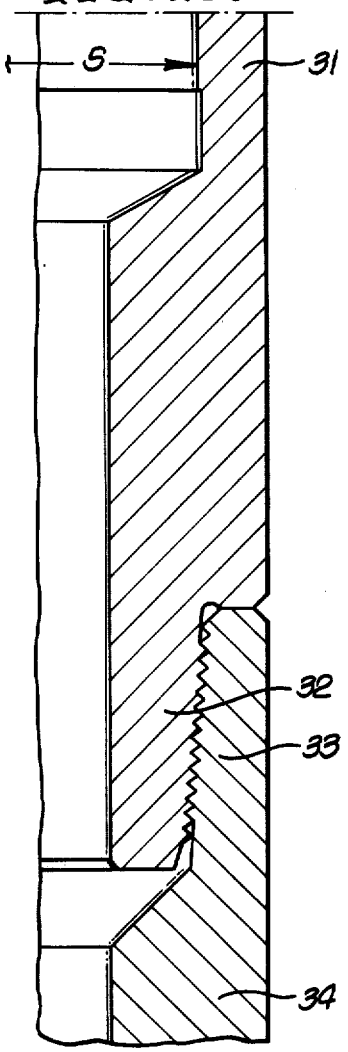

A shock absorber 10 is illustrated in the drawings which is adapted to be secured in a string of drill pipe and drill collars 11 and to a drill bit (not shown) used in the rotary drilling of a bore hole in earth formations. The shock absorber includes an inner body or mandrel 12 telescopically arranged within an outer housing 13. As shown, an upper body or mandrel section 14 has its upper threaded box 15 secured to the threaded pin 16 of an adjacent drill collar section 11 of the drilling string, the lower end of the upper section being threadedly secured to the upper end of an intermediate body or mandrel section 17, the lower end which is threadedly secured to the upper end of a lower body or mandrel section 18. The outer housing includes an upper housing section 19 having a seal sleeve 20 fixed thereto, as by a weld 21, this seal sleeve carrying a suitable seal ring 22 adapted to slidably seal against the periphery of the upper body section 14. The sleeve also carries a suitable elastomeric wiper ring 23 bearing against the periphery of the inner mandrel or body section 14 which is urged against such periphery by a contractible ring 24. Between the wiper ring 23 and the seal ring 22 is disposed a suitable bearing ring 25 surrounded by an "O" ring 26.

A bushing 27 is disposed within the upper housing section 19 below the seal sleeve 20, slidably engaging the periphery of the inner body or mandrel section 14, this bushing resting upon an upwardly facing shoulder 28 of the upper housing section, the bushing serving to retain the inner body section 14 in appropriate slidable relation with the outer housing 13. The lower end of the upper housing section 19 is threadedly secured to the upper end of an intermediate housing section 29, the lower end of which is threadedly secured to the upper end of another intermediate housing section 30 whose lower end is threadedly secured to the upper end of a lower housing section 31 that has a threaded pin 32 threadedly engaged with a threaded box 33 which may be a drill collar section or sub-34 to which a rotary drill bit (not shown) is connected. The part 34 may be the upper end of a fluid motor (not shown), the lower end of which is connected to a rotary drill bit.

The inner body 12 and housing 13 can move axially with respect to each other between a contracted condition and an extended condition. In addition, torque can be transmitted between the inner body or mandrel and the outer housing through a slidable spline connection 36. As illustrated, the inner body section 14 has longitudinally extended external grooves 37 therein receiving keys 38 disposed in opposed internal grooves 39 in the intermediate housing section 29, the keys being prevented from moving to any substantial longitudinal extent by engaging the lower end 40 of the upper housing section 19 and by an upwardly facing shoulder 41 in the intermediate housing section 29. It is to be noted that the external grooves or keyways 37 in the upper mandrel section are of extended length with respect to the keys 38 to permit the inner body 12 to move longitudinally in both directions within and with respect to the housing while permitting torque to be transmitted from the drill string 11 and inner body 12 to the outer housing 13, and from the outer housing to the drill bit or lower drill collar section 34 connected thereto.

During the rotary drilling of the bore hole, the drill bit produces vibrations in the drilling string which it is desired to absorb in the shock absorber, to prevent such vibrations or shock loads from damaging the shock absorber and portions of the drill string. As disclosed, a spring assembly 50 is disposed in an annular chamber 51 between the intermediate body or mandrel section 17 and the lower intermediate housing section 30, the assembly being disclosed as a stack of frusto-conical spring discs or washers 52. The upper end of the frusto-conical disc members bears against an upper thrust ring 53 adapted to contact the lower end of a bushing or spring stop 54 confined within the intermediate housing section between a shoulder 55 provided by the inner intermediate housing section and a shoulder 56 on the lower intermediate housing section 30. The upper thrust ring 53 is also engageable by a downwardly facing shoulder 57 on the intermediate body or mandrel section 17. The lower end of the disc or washer spring stack 50 (also known as a stack of Belleville washers) bears against a lower thrust ring 60, the lower end of which is engageable with an upwardly facing lower spring stop or shoulder 61 on the lower intermediate housing section 30, and by the upper end 62 of the lower body or mandrel section 18 of the inner body 12.

Figure 5:
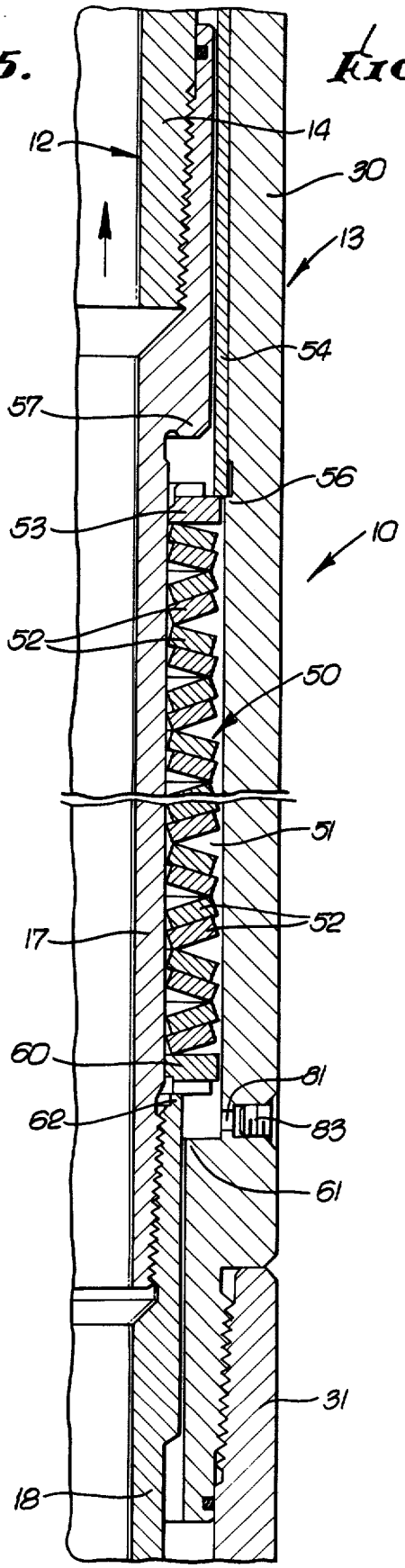
FIG. 5 is a view similar to FIG. 4 disclosing the spring assembly compressed in an upward direction.
Figure 4:
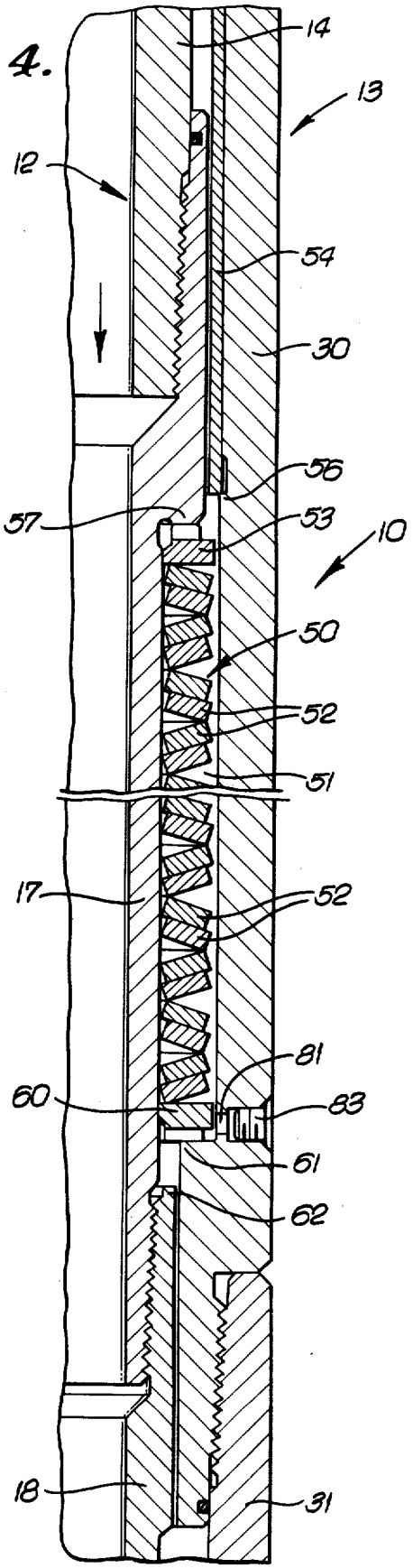
FIG. 4 is a fragmentary view corresponding to FIGS. 1*c* and 1*d* disclosing the spring assembly of the shock absorber compressed in a downward direction.

With the arrangement so far described, the body 12 can move downwardly with respect to the housing 13 to compress the spring assembly 50 between the upper compression shoulder 57 of the body and the lower spring stop 61 of the housing. The body 12 can also move upwardly within the housing 13 to compress the spring stack between the lower compression shoulder 62 and the lower end of the bushing or spring stop 54. Thus, the spring assembly 50 is placed under compression as result of relative downward movement of the body within the housing, as well as relative upward movement of the body within the housing, as shown in FIGS. 4 and 5, respectively.

Figure 3:
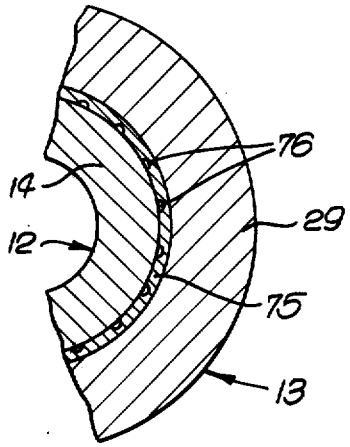
FIG. 3 is a cross-section taken along the line 3—3 on FIG. 1*c*.
Figure 2:
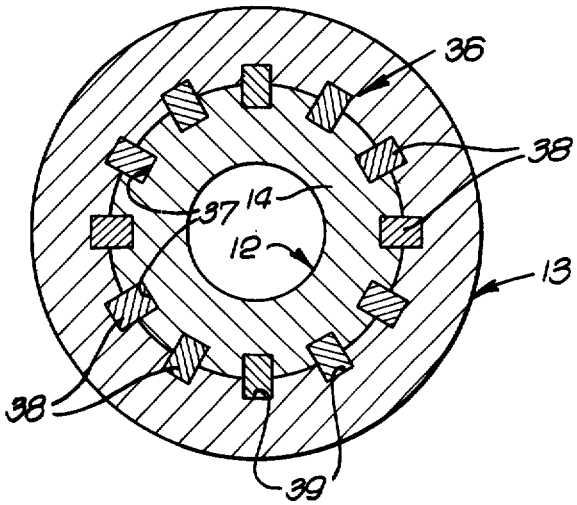
FIG. 2 is a cross-section taken along the line 2—2 on FIG. 1*b*.

During the drilling operation, drilling mud or other drilling fluid is pumped down through the drill string 11, shock absorber 10 and the tubular member 34 and drill bit therebelow for the purpose of flushing the cuttings from the drilling region in the bore hole and conveying them upwardly through the annulus surrounding the drill string to the top of the bore hole. To insure freedom of movement of the telescopic shock absorber parts with respect to each other, a lubricant chamber 51 is provided between the housing and body, this chamber being of extended length, running from an annular compensating piston 70 surrounding the lower portion of the lower body or mandrel section 18 and engaging the inner wall 71 of the lower housing section 31. This piston carries suitable inner seal rings 72 engaging the periphery of the mandrel section 18 and outer seal rings 73 engaging the inner wall of the lower housing section. The lubricant chamber 51 extends from the piston 70 upwardly between the body and housing sections 18, 31, through the spring chamber 51, and through the rotary key and keyway drive portion 36 of the apparatus, and along the bushing 27, terminating at the seal ring 22 in the seal sleeve 20. A bearing ring 75 is provided in the upper intermediate housing section that engages the periphery of the upper mandrel section 14. However, to permit lubricant to flow past such bearing ring, it is provided with longitudinal internal grooves 76, as shown in FIG. 3.

The compensating piston 70 serves to transfer the pressure of the drilling fluid being pumped through the apparatus to the lubricant within the chamber 51 that completely fills the chamber between the compensating piston and the seal ring 22. Downward movement of the compensating piston with respect to the lower body or mandrel section 18 is limited by engagement of the piston with the upper end of a stop ring 77 confined between a shoulder 78 in the lower body section and a split snap ring 79 mounted in a groove 80 in the lower mandrel section and upon which the stop ring 77 rests.

The lubricant can be placed within the elongate lubricant chamber 51 through a suitable port 81 in the lower end of the spring chamber, the lubricant rising in the chamber to an upper port 82 in the upper housing section to permit air to be expelled from the chamber. The shock absorber may be filled when placed in a substantially horizontal condition, but tilted to a small extent in an upward direction, enabling the entire chamber 51 to be completely filled with oil, with substantially no air remaining therein, whereupon the lower port 21 is closed by suitable threaded plug 83 and the upper port 82 is closed by a suitable threaded plug 84.

During the performance of a drilling operation, the drilling fluid is being pumped through the string of drill pipe and shock absorber, discharging through the nozzles or orifices (not shown) of the drill bit, and then proceeding upwardly around the apparatus and the drill string to the top of the well bore. A pressure differential is present within the apparatus because of the restrictions to fluid flow presented by the orifices or nozzles. By way of examples, the pressure differential within the apparatus may be from about 300 to 700 psi. This pressure differential is acting upon the end area P (FIG. 1*a*) of the body or mandrel 12, tending to elevate it together with the drill string 11 thereabove. In drilling at shallow depths, or when performing a well bore reaming operation, the drilling weight that can be imposed upon the drill bit or reamer bit is relatively low. As a result, the inner body 12 will move upwardly within the housing to prevent any downward thrust from being transmitted from the inner body 12 through the spring assembly 50 to the lower spring stop or shoulder 61 in the outer member, this condition being presented in FIG. 5. The necessary force for pressing the cutters of the bit against the formation is then produced by the fluid pressure acting across the transverse area S of the lower housing section 31 and of the drill bit therebelow (except for the relatively small area through the bit nozzles or orifices). Despite the fact that there is no downward thrust being transmitted from the inner body 12 through the spring stack 50 under the conditions referred to, the spring stack is still under compression, being compressed between the upwardly facing shoulder 62 of the lower body or mandrel section 18 and the lower end of the spring stop 54 within the outer housing section 30. Vibrations resulting from the action of the drill bit rotating in the bore hole are then absorbed and dampened by the compressed spring assembly.

On the other hand, should the drilling weight imposed upon the bit by the drill string be greater than the upward thrust of the fluid pressure on the inner body or mandrel, the spring assembly 50 will be compressed between the upper shoulder 57 of the inner member and the lower spring stop 61 on the outer member (FIG. 4). Actually the total force imposed upon the drill bit will be attributable to the downweight imposed by the drill string 11 and the hydraulic force imposed by the drilling fluid within the shock absorber acting in a downward direction on the housing section 31 and drill bit therebelow. Under the condition just described, the spring assembly will be in compression, to provide an apparatus capable of damping and absorbing drill bit vibrations and other shock loads developed in the bore hole.

Although specific reference has been made to the drilling of the bore hole through rotation of the drill string 11, shock absorber 10 and drill bit, the shock absorber can also be connected to the upper end of a down hole fluid motor 34 used for rotating a drill bit without rotating the drill string 11 and shock absorber thereabove. Under this condition, the lower end 32 of the shock absorber will be connected to the upper end of the fluid motor 34, the drive shaft (not shown) of which will be connected to the drill bit. In this combination, the same pressure conditions will be present in the shock absorber. Where the weight imposed on the bit is relatively low, reliance is then placed on the fluid pressure to exert the appropriate thrust of the bit against the bottom of the bore hole (FIG. 5), the inner body 12 being hydraulically elevated sufficiently to compress the spring assembly 50 between the lower compression shoulder 61 on the body and the lower end of the bushing or spring stop 54 mounted within the housing. When the drilling weight is sufficient to overcome the elevating force of the fluid pressure (FIG. 4), the drilling weight will cause the inner body 12 to move downwardly with respect to the housing 13 to compress the spring assembly 50 between the upper body shoulder 57 and the lower housing stop 61.

I claim:

1. A shock absorber for bore hole drilling strings, comprising a telescopic structure including an outer tubular member, an inner tubular member within said outer member, said members having means for connecting said structure in a drilling string, whereby drilling fluid can be conducted through the drilling string and said inner and outer tubular members, rotary drive means for transmitting torque between said members while said members are moving axially with respect to each other, a single spring means between said outer and inner members, said outer member having longitudinally spaced upper and lower shoulders at opposite ends of said spring means, said inner member having longitudinally spaced upper and lower shoulders at opposite ends of said spring means, the upper shoulder of one member and the lower shoulder of the other member simultaneously engaging and stressing said spring means upon longitudinal contraction of said members with respect to each other, the upper shoulder of the other member and the lower shoulder of said one member simultaneously engaging and stressing said spring means upon extension of said members with respect to each other, said inner and outer members having transverse surfaces responsive to the pressure of the fluid flowing through said members which tends to extend said members relative to each other.

2. A shock absorber as defined in claim 1; said single spring means being placed under compression in response to longitudinal contraction and extension of said members with respect to each other.

3. A shock absorber as defined in claim 2; said spring means comprising an assembly of coengageable frustoconical parts.

4. A shock absorber for bore hole drilling strings, comprising a telescopic structure including an outer tubular member, an inner tubular member within said outer member, said members having means for connecting said structure in a drilling string, rotary drive means for transmitting torque between said members while said members are moving axially with respect to each other, a single spring means between said outer and inner members, said outer member having longitudinally spaced upper and lower shoulders at opposite ends of said spring means, said inner member having longitudinally spaced upper and lower shoulders at opposite ends of said spring means, the upper shoulder of one member and the lower shoulder of the other member simultaneously engaging and stressing said spring means upon longitudinal contraction of said members with respect to each other, the upper shoulder of the other member and the lower shoulder of said one member simultaneously engaging and stressing said spring means upon extension of said members with respect to each other, said inner member extending longitudinally in one direction beyond one end of said outer member and terminating within said outer member, means beyond one end of said spring means providing a first seal between an outer periphery of said inner member and the inner wall of said outer member, means beyond the other end of said spring means providing a second seal between the outer periphery of said inner member and the inner wall of said outer member, and means for conducting a lubricating fluid into an annular space between said inner and outer members and extending from said first seal to said second seal.

5. A shock absorber as defined in claim 4; said rotary drive means being located in said annular space.

6. A shock absorber as defined in claim 4; said second seal comprising a compensating piston slidably sealingly engaged with the outer periphery of said inner member and the inner wall of said outer member.

7. A shock absorber as defined in claim 6; said inner and outer members having transverse surfaces responsive to the pressure of the drilling fluid flowing through said members which tends to extend said members relative to each other.

8. A shock absorber for bore hole drilling strings, comprising a telescopic structure including an outer tubular member, an inner tubular member within said outer member, said members having means for connecting said structure in a drilling string, rotary drive means for transmitting torque between said members while said members are moving axially with respect to each other, a single spring means between said outer and inner members, said outer member having longitudinally spaced upper and lower shoulders at opposite ends of said spring means, said inner member having longitudinally spaced upper and lower shoulders at opposite ends of said spring means, the upper shoulder of one member and the lower shoulder of the other member simultaneously engaging and stressing said spring means upon longitudinal contraction of said members with respect to each other, the upper shoulder of the other member and the lower shoulder of said one member simultaneously engaging and stressing said spring means upon extension of said members with respect to each other, said inner member extending upwardly beyond the upper end of said outer member and having its lower terminus within said outer member, means above said spring means and upper shoulders providing a seal between an outer periphery of said inner member and the inner wall of said outer member, compensating piston means below said spring means and lower shoulders slidably sealingly engaged with an outer periphery of said inner member and the inner wall of said outer member, and means for conducting a lubricating fluid into the annular space between said inner and outer members and extending from said first seal means to said piston means.

9. A shock absorber as defined in claim 8; said seal means being located above said rotary drive means.

10. A shock absorber as defined in claim 8; said spring means comprising an assembly of coengageable frusto-conical parts.

11. A shock absorber as defined in claim 10; said rotary drive means being located in said annular space.

12. A shock absorber as defined in claim 11; said inner and outer members having transverse surfaces responsive to the pressure of the drilling fluid flowing through said members which tends to extend said members relative to each other.

13. A shock absorber for bore hole drilling strings, comprising a telescopic structure including an outer tubular member, an inner tubular member within said outer member, said members having means for connecting said structure in a drilling string, rotary drive means for transmitting torque between said members while said members are moving axially with respect to each other, a single spring means between said outer and inner members, said outer member having longitudinally spaced upper and lower shoulders at opposite ends of said spring means, said inner member having longitudinally spaced upper and lower shoulders at opposite ends of said spring means, the upper shoulder of one member and the lower shoulder of the other member simultaneously engaging and stressing said spring means upon longitudinal contraction of said members with respect to each other, the upper shoulder of the other member and the lower shoulder of said one member simultaneously engaging and stressing said spring means upon extension longitudinal contraction and extension of said members with respect to each other, said spring means comprising an assembly of coengageable frusto-conical parts, said inner member extending longitudinally in one direction beyond one end of said outer member and terminating within said outer member means, means beyond one end of said spring means providing a first seal between an outer periphery of said inner member and the inner wall of said outer member, means beyond the other end of said spring means providing a second seal between the outer periphery of said inner member and the inner wali of said outer member, and means for conducting a lubricating fluid into an annular space between said inner and outer members and extending from said first seal to said second seal.

14. A shock absorber as defined in claim 13; said rotary drive means being located in said annular space.

* * * * *